US006079498A

United States Patent [19]

Lima et al.

[11] Patent Number: 6,079,498

[45] Date of Patent: Jun. 27, 2000

[54] METHOD AND EQUIPMENT FOR THE FLOW OF OFFSHORE OIL PRODUCTION

[75] Inventors: Paulo Cesar Ribeiro Lima, Milton Keynes, United Kingdom; Divonsir Lopes; Fernando Antonio Costa Sidrim, both of Rio de Janeiro, Brazil

[73] Assignee: Petroleo Brasileiro S.A. - Petrobras, Brazil

[21] Appl. No.: 09/117,353

[22] PCT Filed: Jan. 29, 1997

[86] PCT No.: PCT/GB97/00250

§ 371 Date: Jul. 28, 1998

§ 102(e) Date: Jul. 28, 1998

[87] PCT Pub. No.: WO97/28350

PCT Pub. Date: Aug. 1, 1997

[30] Foreign Application Priority Data

Jan. 29, 1996 [BR] Brazil ..... 9600249

[51] Int. Cl.[7] ..... E21B 43/00

[52] U.S. Cl. ..... 166/370; 166/345; 166/170; 166/70; 405/169

[58] Field of Search ..... 166/70, 75.15, 166/47.5, 372, 370, 383, 335; 405/158, 169–171; 15/104.062; 137/268

[56] References Cited

U.S. PATENT DOCUMENTS

| | | | |
|---|---|---|---|
| 3,291,217 | 12/1966 | Wakefield | 166/75.15 |
| 3,608,631 | 9/1971 | Sizer | 166/70 |
| 4,989,671 | 2/1991 | Lamp | 166/372 X |
| 5,040,603 | 8/1991 | Baldridge | 166/70 X |
| 5,199,496 | 4/1993 | Redus et al. . | |
| 5,267,616 | 12/1993 | Silva et al. . | |
| 5,435,338 | 7/1995 | Da Silva et al. . | |
| 5,437,302 | 8/1995 | Da Silva et al. . | |
| 5,460,277 | 10/1995 | Silva . | |
| 5,478,504 | 12/1995 | de Almeida Barbuto . | |
| 5,636,693 | 6/1997 | Elmer | 166/372 X |
| 5,913,637 | 6/1999 | Rajabali et al. | 405/169 |

FOREIGN PATENT DOCUMENTS

| | | |
|---|---|---|
| 568 742 | 11/1993 | European Pat. Off. . |
| 0 583 913 | 2/1994 | European Pat. Off. . |
| 583 912 | 2/1994 | European Pat. Off. . |
| 9201842 | 11/1993 | Poland . |
| 2 282 399 | 4/1995 | United Kingdom . |
| 97/28351 | 8/1997 | WIPO . |

*Primary Examiner*—Dennis L. Taylor
*Attorney, Agent, or Firm*—Nixon & Vanderhye PC

[57] ABSTRACT

This invention relates to a method and equipment to assist the flow of offshore oil production. At least three production flow lines are used, which are interconnected close to offshore well-heads or manifolds forming two U-shaped lengths of pipe acting as circuits for passage of the hydrocarbon mixture produced. A mechanical interface is periodically inserted into one flow line of the U-shaped branches of pipe and, driven by a volume of pressurized gas, travels along the one from among the two U-shaped pipe length to return to a gathering center. In its passage it pushes along the volume of hydrocarbon mixture which has accumulated in the flow lines.

6 Claims, 3 Drawing Sheets

METHOD AND EQUIPMENT FOR THE FLOW OF OFFSHORE OIL PRODUCTION

This application is the national phase of international application PCT/GB97/00250 filed Jan. 29, 1997 which designated the U.S.

1. Field of the Invention

This invention relates to method and equipment to assist the mixture of hydrocarbons produced by an offshore oil well or collected in an offshore manifold which receives the output from various wells, for subsequent gathering to flow to the surface.

2. Prior Art

The growing exploration for oil in increasingly deeper waters has made it necessary for those skilled in the art to develop new techniques to increase the production of hydrocarbons from offshore wells. It is known that the mixtures of hydrocarbons originating from wells can vary substantially in respect of the volumes of their phases, which are normally water, oil and gas.

Once the step of obtaining the greatest possible volume of the mixture of hydrocarbons from a well has been completed, it is then necessary to deliver it to a gathering centre which has primary processing facilities. This place may be an offshore platform, a vessel or even an onshore gathering station. The mixture is discharged to the gathering centre via pipelines which may be rigid or flexible, or even a combination of both.

Very often the reservoir pressure itself is the only energy used to promote flow of hydrocarbon mixture along these pipelines to the gathering centre. However, this arrangement has a number of disadvantages, because the formation of a column containing a significant volume of liquid in riser pipes can give rise to an undesirable increase in pressure in the well-head or manifold which can even prevent a large flow of the mixture from reaching the gathering centre. There may also be extreme situations in which the reservoir pressure is simply incapable of maintaining flow to the gathering centre.

It is then necessary to use some means of pumping. Centrifugal pumps and positive displacement pumps are widely used in the pumping operations required at the surface and in onshore oil wells. However, because of its low reliability and also because of the high frequency of maintenance operations which this usually requires, the application of pumping to offshore wells, especially those located at great depths, is still considered difficult. Another limiting factor is the composition of the produced hydrocarbon mixture itself, because the presence of gas in it can give rise to great difficulties in pumping operations.

Another arrangement which may also be used is to inject liquids or gases at high pressures into the pipelines in order to encourage conditions in which the mixture of hydrocarbons will flow to the gathering centre. This arrangement has the disadvantage that it gives rise to an additional back pressure at the well-head or in the manifold, which creates even more difficulties for the flow of hydrocarbon mixture, and generally results in a fall in output.

Brazilian Patent Application PI9201842-4, by the applicant, proposes that mechanical interfaces should be inserted at intervals within flow lines so as to create moving barriers which seal off sections of the pipes, maintaining a constant mass of hydrocarbon mixture within these sections. It also provides for the possibility of inserting mechanical interfaces in the production column within a well.

However, the need to insert mechanical interfaces at intervals is an operational aspect which can give rise to some difficulties in applications. Another aspect which has to be considered is that the constant existence of areas of high pressure within the production system could give rise to a back pressure which would reduce the flow of the hydrocarbon mixture emerging from the producing region.

OBJECT OF THE INVENTION

It is an object of this invention to propose equipment and a method which make use of a single mechanical interface powered by high pressure gas to promote flow of the produced mixture, eliminating the above-mentioned disadvantages.

SUMMARY OF THE INVENTION

According to a first aspect of the present invention there is provided equipment for gathering offshore oil production, characterized in that it comprises:

at least three flow lines which form two U-shaped lengths of pipe, and a line which connects with an offshore well-head or well manifold and which divides into further lines which are each connected to one of the two U-shaped lengths of pipe;

in that each of these further lines is equipped with a check valve; and in that the equipment permits the periodical passage of a mechanical interface through one or other of the U-shaped lengths of pipe so as to promote flow, to a gathering centre, of the mixture of hydrocarbons which has accumulated in the flow lines.

A second aspect of the invention provides a method for the gathering of offshore oil production from a well-head or well-head manifold, characterized in that only three flow lines are used to form two U-shaped lengths of pipe; and in that such method includes the following steps:

initially opening first and second valves in one of said U-shaped pipe lengths and closing third and fourth valves in the other U-shaped pipe length with a view to accumulating a volume of hydrocarbon mixture from the well-head/manifold in the flow lines constituting the said one U-shaped pipe length;

when a sufficient volume of hydrocarbon mixture has accumulated in these flow lines, opening said first valve and starting the process of launching a mechanical interface into a first line of said one U-shaped pipe length by inserting the interface into a launching device and by subsequently opening a gas feed valve to the launching device;

driving the mechanical interface by the high pressure gas, to travel along said first line, to pass along said one U-shaped length of pipe, and to begin its return to a platform through a second line of said one U-shaped pipe length, thus removing the volume of hydrocarbon mixture which has accumulated in the lines defining said one U-shaped pipe length;

using a check valve to prevent the pressurized gas from reaching the well-head/manifold, and preventing the still produced fluid mixture from flowing into the lines of said one U-shaped pipe length as these lines are pressurized by the high pressure gas, while said first valve is open to cause the still produced mixture of hydrocarbons to flow along a third line which, together with said second line, defines said other U-shaped pipe length;

when the mechanical interface reaches a receiving device, removing to a surge tank the volume of hydrocarbon mixture which has accumulated in said lines of said one U-shaped pipe length then closing the gas feed valve and starting the process of depressurizing said first and second lines defining the said one U-shaped pipe length by opening a gas discharge valve, and using the gas released by opening the gas discharge valve to initiate the launching in the next cycle of the or a mechanical interface into said third line which together with said second line defines the other of said U-shaped pipe lengths;

as the last step to be performed in this cycle, opening said fourth valve and closing said first and second valves, thereby making it possible for the hydrocarbon mixture to fill said third and second lines defining said other U-shaped pipe length, through which the mechanical interface will pass in the next cycle of the method;

when the volume of hydrocarbon mixture which has accumulated in said third and second lines has reached a sufficient level, then opening said first valve and starting the process of launching the mechanical interface into said third line by inserting it into the or a launching device and subsequently opening the or a gas feed valve;

by means of the high pressure gas, driving the mechanical interface to pass along said third line, along said other U-shaped length of pipe, through a point of intersection of the outlet from said fourth valve with said second line to begin its return to the platform via said second line, thus removing the volume of hydrocarbon mixture which has accumulated in said third and second lines;

using a check valve to prevent the pressurized gas from reaching the well-head/manifold, and preventing the still produced hydrocarbon mixture from flowing along said third and second lines as these lines are pressurized by the high pressure gas, while said first valve is open to allow all the continuing production then to flow into said first line;

when the mechanical interface reaches the or a receiving device, removing to the or a surge tank the volume of hydrocarbon mixture which has accumulated in said third and second lines;

then closing the gas feed valve and starting the process of depressurizing said third and second lines by opening a gas discharge valve, and using the gas released by opening this valve to initiate the launching of the or a mechanical interface into said first line in the next cycle; and as the last step to be performed in this cycle, opening said second valve and closing said third and fourth valves, thereby allowing filling of said first and second lines through which the mechanical interface will pass in the next cycle of the method.

A third aspect of the present invention provides a method for gathering offshore oil production from a well-head or well-head manifold, characterized in that four flow lines are used to form two U-shaped lengths of pipe; and in that the method includes the following steps:

initially filling the flow lines with the hydrocarbon mixture originating from the well-head/manifold;

when a sufficient volume of hydrocarbon mixture has accumulated in a first line of one or other of the U-shaped pipe lengths, starting the process of launching a mechanical interface into one of said first lines which are interlinked with a launching device, by inserting said mechanical interface into said launching device and subsequently opening a gas feed valve;

driving the mechanical interface, propelled by high pressure gas, to pass along the line into which it has been inserted and along the respective U-shaped length of pipe, and to begin its return to a platform via a second line of the same U-shaped pipe length, thus removing the volume of hydrocarbon mixture which has accumulated in the lines through which the mechanical interface passes;

using a check valve to prevent the pressurized gas from passing into the well-head/manifold assembly and, while the mechanical interface is travelling through one of the sets of lines, causing all continuing production to flow through the other set of lines;

when the mechanical interface reaches a receiving device, removing to a surge tank the volume of hydrocarbon mixture which has accumulated in the lines through which the mechanical interface has passed;

then closing the gas feed valve and starting the process of depressurizing the lines by the injection of high pressure gas by opening a gas discharge valve of the respective first line so as to allow the still produced hydrocarbon mixture then to accumulate in the thus depressurized lines; and then removing the mechanical interface from within the receiving device, and in the next cycle using the gas which is released by opening the gas discharge valve to initiate launching of the or a mechanical interface into the other said first line linked to the launching device.

This invention thus enables oil to be produced in a controlled way, avoiding the accumulation of large quantities of a mixture of fluids in flow lines. The average pressure at the well-head or in the manifold is kept low so as to prevent high pressures from adversely affecting the flow of hydrocarbon mixture at the production head or in the manifold.

At least three interlinked production lines, close to the well-head or manifold, form three U-shaped lengths of pipe. Periodically a mechanical interface, which is displaced by the action of high pressure gas, is passed through each of these three sections. This mechanical interface removes almost all the hydrocarbon mixture which has accumulated in the lines through which it passes.

BRIEF DESCRIPTION OF THE DRAWINGS

The features of this invention will be better understood from the detailed description which follows merely by way of example with reference to the associated drawings which form an integral part of this description.

DETAILED DESCRIPTION OF THE INVENTION

Figure 1:
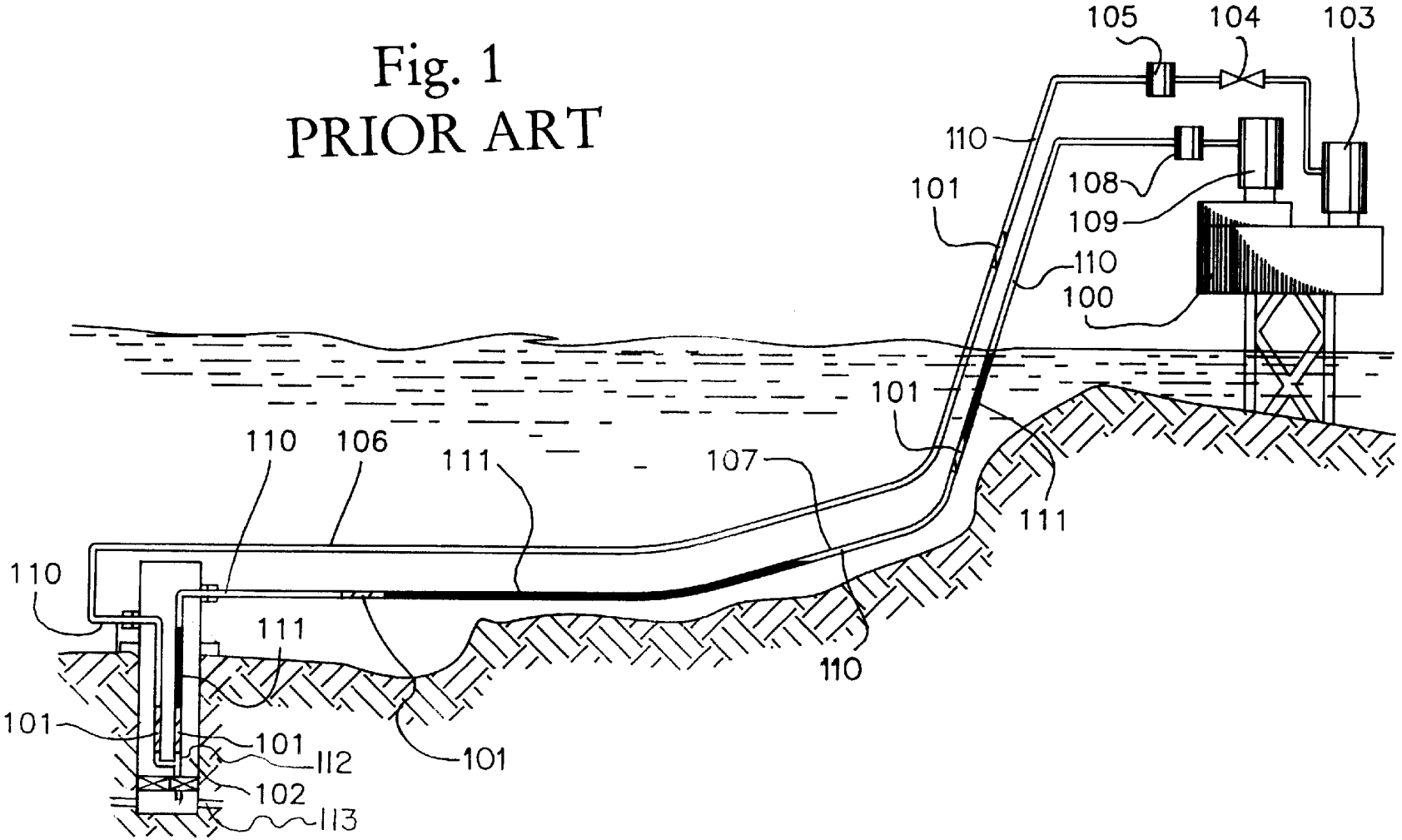
Fig. 1 PRIOR ART
FIG. 1 is a diagrammatical illustration of prior art equipment.

Before describing the present invention, by way of background we make reference to FIG. 1 which shows a diagrammatical illustration of an embodiment relating to the aforementioned Brazilian Patent Application PI9201642-4.

This drawing shows a platform 100, on which is installed a source 103 for the supply of high pressure gas. A gas feed valve 104 controls the feed of gas to a launching device 105 which is responsible for the periodic introduction of mechanical interfaces 101 into an auxiliary line 106. This auxiliary line 106 extends from the platform 100 to within an offshore well 102 and connects with the production column 112 at a point located a little way above the producing region 113 of the well.

Driven by the high pressure gas, mechanical interfaces 101 travel along the auxiliary line 106 until they are inserted into the production column 112. They then travel up the length of this production column 112 and also along a flow line 107 returning to platform 100.

While travelling through the production column 112 and flow line 107 the mechanical interfaces entrain along with them the volume of hydrocarbon mixture which has accumulated in the column and flow line. It will be seen in FIG. 1 that within the piping of the column and flow line there are zones 110 which contain high pressure gas. It will also be seen that there are zones 111 which contain the hydrocarbon mixture produced by the well 102.

On reaching the platform 100, the mechanical interfaces 101 are collected in a collection device 108 and the fluids produced flow to a surge tank 109. The valves and mechanisms which allow the mechanical interfaces to be removed from the interior of the collection system 108, without interrupting the flow of fluids to the surge tank 109, are not shown in FIG. 1.

As has already been described, this arrangement represented a great advance in the art of gathering the production from offshore oil wells. However, the need to insert individual mechanical interfaces periodically in a succession is an operational aspect which can give rise to great difficulty in application. Another aspect which has to be considered is that the constant existence of high pressure zones within the production system can give rise to a back pressure which reduces the flow of hydrocarbon mixture emerging from the producing region.

The present invention proposes equipment and a method which use the passage of a single mechanical interface through the pipes to promote the flow of production.

Figure 2:
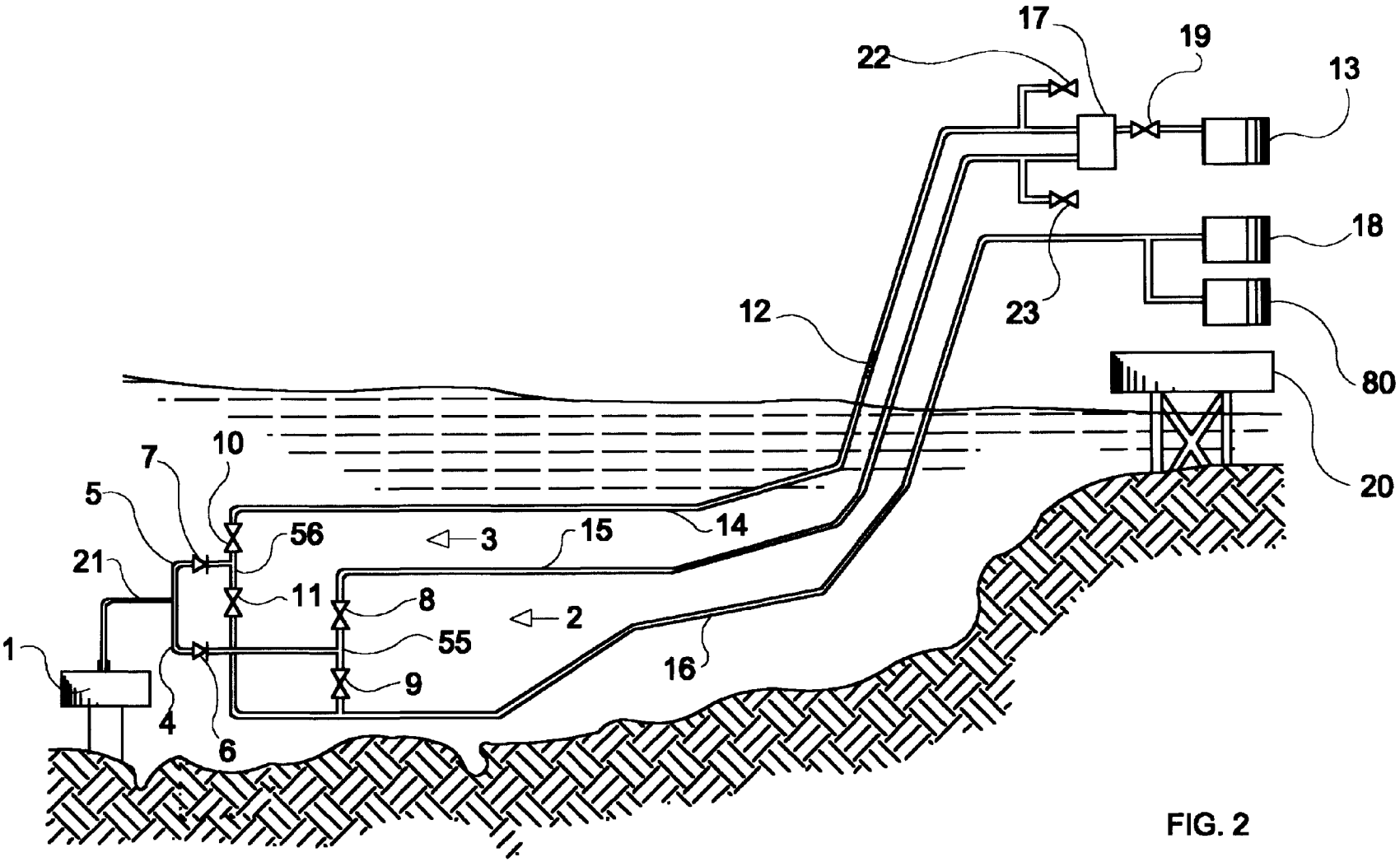
FIG. 2 is a diagrammatical illustration of application of the equipment and method according to this invention, using three production lines forming two interlinked U-shaped lengths of pipe.

FIG. 2 shows a diagrammatical illustration of an embodiment of this invention. Component 1 may be a well-head or a well-head manifold. For the purposes of simplification we will refer to it as the well-head/manifold. Line 21 which leaves the well-head/manifold 1 divides into lines 4 and 5 which are fitted with check valves 6 and 7 respectively.

Line 4 is linked to a U-shaped pipe length 2 formed of lines 15 and 16. Two clear-flow shut-off valves 8 and 9 are installed in the U-shaped pipe length 2 located close to point 55 where the U-shaped pipe length 2 connects with the line 4. A clear-flow valve is one which, when open, will permit the passage of a mechanical interface therethrough along the fluid flow path.

Line 5 connects with a U-shaped pipe 3 formed by lines 14 and 16. Two clear-flow shut-off valves 10 and 11 are located in the length of U-shaped pipe 3 located close to point 56 where the latter connects to line 5.

In this embodiment it is suggested, merely by way of illustration, that the hydrocarbon mixture produced passes into lines 14, 15, and 16 and is then transferred from these lines into a surge tank 80 located on the platform 20. The gathering centre for this mixture could instead be a vessel or even an on-shore gathering station.

A launcher device 17 is responsible for the launching of a mechanical interface 12 into lines 14/16 or 15/16. An external energy source of pressurized gas, represented in FIG. 2 by a tank 13, is responsible for supply of the gas used to drive a mechanical interface 12 for travel along the lines 14/16 or 15/16. A gas feed valve 19 controls the flow of gas between the tank 13 and the launcher device 17.

An interface receiving device 18 is responsible for the operation of receiving the mechanical interface 12 a returning along line 16 after the interface has travelled along flow lines 14/16 or 15/16. Gas discharge valves 22 and 23 are responsible for depressurizing the line systems 14/16 and 15/16 respectively.

In this embodiment the surge tank 80, and all the components involved in the operations of launching and receiving the mechanical interface 12, are located at the gathering centre for the hydrocarbon mixture produced, shown in FIG. 2 by the platform 20.

Before describing the method of using the equipment illustrated in FIG. 2 it is important to point out that all the process of opening and closing the valves mentioned in this embodiment is controlled remotely from a location which is preferably located close to the gathering centre. For the purpose of simplifying the drawings it has been decided not to show the control lines for these valves. This comment also applies to the embodiment illustrated in FIG. 3.

The method of using the equipment illustrated in FIG. 2 begins with the opening of clear-flow valves 10 and 11 and the closing of clear-flow valves 8 and 9. The hydrocarbon mixture originating from the well-head/manifold 1 then accumulates in lines 14 and 16. When the hydrocarbon mixture thus accumulating in these lines has reached the desired level, the clear-flow valve 8 is opened. The process of launching mechanical interface 12 into line 14 then begins with insertion of the interface into launching device 17, followed by the opening of gas feed valve 19.

Driven by the high pressure gas, the mechanical interface 12 travels along the line 14, through the U-shaped pipe length 3, and begins its return to the platform 20 along the line 16, thus removing the volume of hydrocarbon mixture which has accumulated in the two lines 14 and 16. The non-return valve 7 prevents the pressurized gas from reaching well-head/manifold assembly 1.

The mixture of hydrocarbons still being produced is prevented from flowing into the two lines 14 and 16 as these lines are pressurized by the high pressure gas. As the clear-flow valve 8 is open, the hydrocarbon mixture still being produced then flows to line 15.

When the mechanical interface 12 reaches the receiver device 18 the volume of hydrocarbon mixture which had accumulated in the lines 14 and 16 will have been removed to the surge tank 80. The gas feed valve 19 is then closed and the process of depressurizing lines 14 and 16 is begun by opening the gas discharge valve 22. The gas released by opening this valve 22 may for example be used to initiate the launching of the mechanical interface 12 into the line 15 in the next cycle.

The last step which has to be performed in this cycle is the opening of the clear-flow valve 9 and the closing of clear-flow valves 10 and 11. This allows the lines 15 and 16 to fill, and the same or another mechanical interface 12 then passes through these two lines during the next cycle of the method.

When the volume of hydrocarbon mixture which has accumulated in lines 15 and 16 has reached the desired level, the clear-flow valve 10 is then opened and subsequently the process of launching the mechanical interface 12 into the line 15 is begun by inserting it in the launching device 17 and then opening gas feed valve 19.

Driven by the high pressure gas, the mechanical interface 12 passes along the line 15, along the U-shaped pipe length 2, through the point of intersection 57 of the outlet of valve 9 with the flow line 16, and begins its return to platform 20 along line 16, thus removing the hydrocarbon mixture which has accumulated in the two lines 15 and 16. The check valve 6 prevents the pressurized gas from reaching the well-head/manifold 1.

Meanwhile the mixture of hydrocarbons still being produced is prevented from flowing into the lines 15 and 16 as these lines are pressurized by the high pressure gas. All the production then flows to the line 14.

When the mechanical interface 12 reaches the receiving device 18, the hydrocarbon mixture which had accumulated in lines 15 and 16 will have been removed to the surge tank 80. The gas feed valve 19 is then closed and the process of depressurizing the lines 15 and 16 is then begun by opening the gas discharge valve 23. The gas released by this may, for example, be used to initiate the launching of the same or another mechanical interface 12 into the line 14 in the next cycle.

The last step which has to be performed in this cycle is the opening of the clear-flow valve 11 and the closing of the clear-flow valves 8 and 9. Through this procedure the lines 14 and 16 can be filled, and the mechanical interface 12 will travel along them during the next cycle in the method.

It should be pointed out that the receiving device 18 has internal mechanisms which make it possible for the mechanical interface 12 to be removed without interrupting the flow of hydrocarbon mixture to the surge tank 80. The launching device 17 also has internal handling mechanisms which make it possible to select the line 14 or 15 into which the mechanical interface 12 is to be launched. These mechanisms are not shown in FIG. 2 as they do not form part of the invention and as they are also widely known to those skilled in the art.

Figure 3:
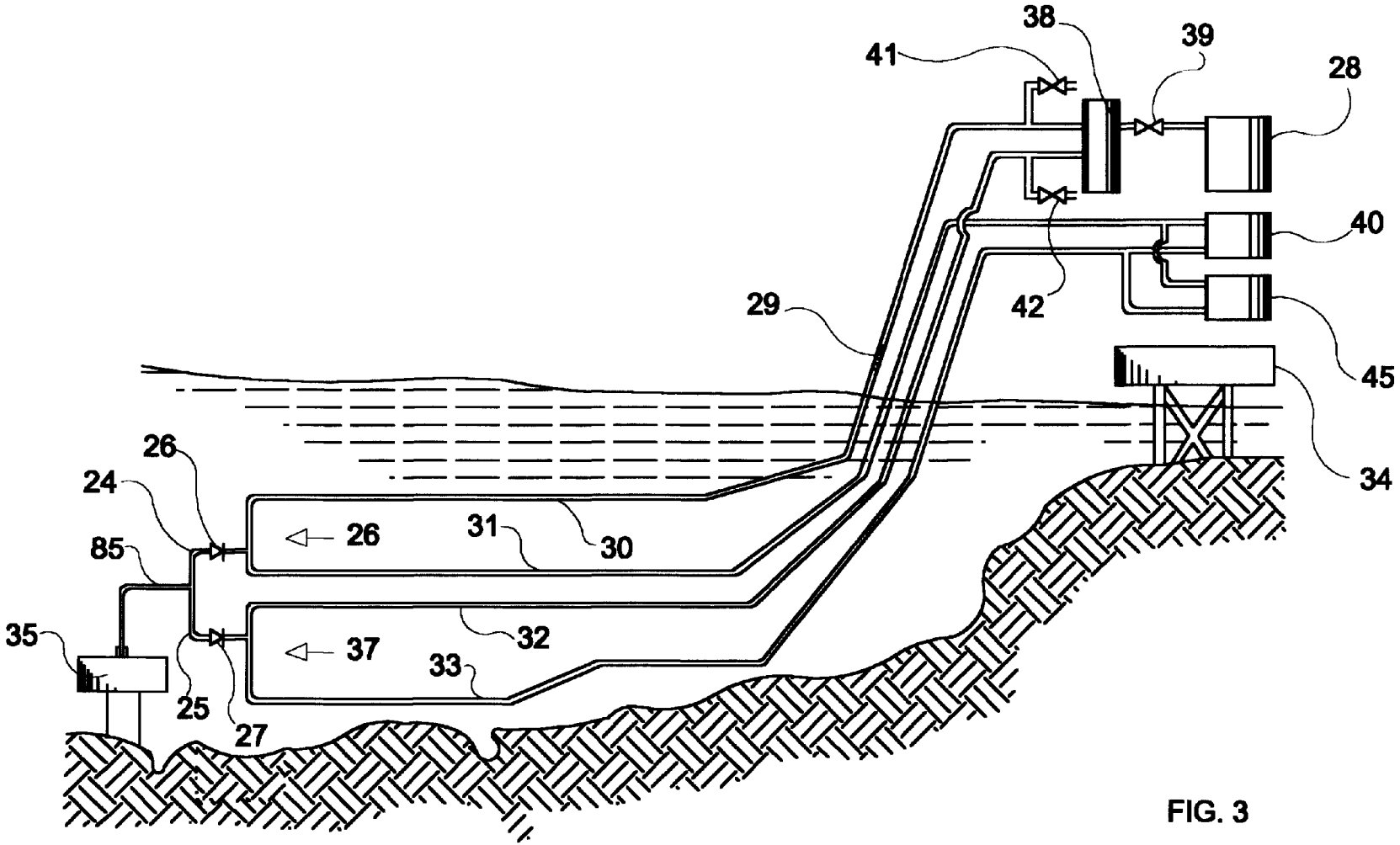
FIG. 3 is a diagrammatical illustration of the application of the equipment and method according to this invention, four production lines forming two independent U-shaped lengths of pipe.

FIG. 3 illustrates another embodiment of this invention. Again the component 35, referred to here as the well-head/manifold, may be a well-head or a manifold linking several well-heads. The line 85 which leaves the well-head/manifold 35 divides into two lines 24 and 25 which have check valves 26 and 27 respectively. The line 24 is connected to a first U-shaped pipe length 36 formed by lines 30 and 31, and the line 25 is connected to an independent second U-shaped pipe length 37 formed by lines 32 and 33.

In this embodiment it is suggested, merely by way of illustration, that the hydrocarbon mixture produced is passed along lines 30, 31, 32 and 33 to a surge tank 45 located on a platform 34. The gathering centre for the mixture may also be a vessel or even an onshore gathering station.

An external source of energy, from pressurized gas, is shown in FIG. 3 by a tank 28 and is responsible for supplying the gas used to drive a mechanical interface 29 along the lines 30/31 or 32/33. A launching device 38 is responsible for the operation of launching a mechanical interface 29 into the lines 30/31 or 32/33.

A gas feed valve 39 controls the supply of gas between the supply tank 28 and the launching device 38. A receiving device 40 is responsible for the operation of receiving the mechanical interface 29 after it has passed along the flow lines 30/31 or 32/33. Gas discharge lines 41 and 42 are responsible for depressurizing the sets of lines 30/31 and 32/33 respectively.

In this embodiment a surge tank 45, and all the components involved in the operations of launching and receiving mechanical interface 29, are located at the gathering centre for the hydrocarbon mixture produced, in this case the platform 34 shown in FIG. 3.

The method of using the equipment illustrated in FIG. 3 begins with filling the four lines 30, 31, 32 and 33 with the mixture of fluids originating from the well-head/manifold 35. When a sufficient volume of hydrocarbon mixture has accumulated in the lines, the process of launching the mechanical interface 29 into line 30 begins by inserting the interface into the launching device 38 and subsequently opening the gas feed valve 39.

Driven by the high pressure gas, the mechanical interface 29 passes along the line 30, along the U-shaped pipe length 36 and begins its return to the platform 20 along line 31, thus removing the volume of hydrocarbon mixture which has accumulated in these two lines 30 and 31. The non-return valve 26 prevents pressurized gas from passing to the well-head/manifold assembly 35. While the mechanical interface 29 is passing along the lines 30 and 31 all the continuing production flows to the lines 32 and 33.

When the mechanical interface 29 reaches the receiving device 40 the hydrocarbon mixture which had accumulated in the lines 30 and 31 will have been removed to the surge tank 45. The gas feed valve 39 is then closed and the process of depressurizing the lines 30 and 31 is begun by opening the gas discharge valve 41 so as to allow the continuing production of hydrocarbon mixture to accumulate also in these lines. The gas released by opening the valve 41 may for example be used to initiate the launching of the same or another mechanical interface 29 into line 32 in the next cycle.

When a sufficient volume of hydrocarbon mixture has accumulated in lines 32 and 33, the process of launching the mechanical interface 29 into the line 32 can then begin. For this the same operations as described previously must be performed mutatis mutandis, namely the mechanical interface 29 is inserted into the launching device 38, and the gas feed valve 39 is opened so as to allow the mechanical interface 29 thereby to be introduced into the line 32.

It should be pointed out that the launching device 38 has internal operating mechanisms which make it possible to select into which line 30 or 32 the mechanical interface 29 will be inserted. These mechanisms are not described in this description as they do not form an integral part of the invention and are widely known to those skilled in the art.

Driven by the high pressure gas, the mechanical interface 29 passes along the line 32, along the U-shaped pipe length 37 and begins its return to the platform 34 along the line 33, thus removing to the surge tank 45 the volume of hydrocarbon mixture which has accumulated in the two lines 32 and 33. The check valve 27 prevents pressurized gas from passing to the well-head/manifold assembly 35. While the mechanical interface 29 is passing along the lines 32 and 33 all the continuing production is diverted to the lines 30 and 31.

When the mechanical interface 29 reaches the receiving device 40 the volume of hydrocarbon mixture which had accumulated in lines 32 and 33 will have been removed. The gas feed valve 39 is then closed and the process of depressurizing the lines 32 and 33 is then begun by opening the gas discharge valve 42 so as to allow the hydrocarbon mixture also to accumulate in these lines. The gas released by opening the valve 42 may, for example, be used to initiate the launching of the mechanical interface 29 in the next cycle when it is again launched into the line 30.

It should be pointed out that the receiving device 40 has internal mechanisms which allow mechanical interface 29 to be withdrawn without interrupting the flow of hydrocarbon mixture to surge tank 45. In addition to this launching device 38 has internal operating mechanisms which make it possible to select the line into which mechanical interface 29 is launched. These mechanisms are not shown in FIG. 3 as If they do not form an integral part of the invention and also because they are widely known to those skilled in the art.

The launching devices and the receiving devices mentioned in the two embodiments described in this description may, for operational convenience, be combined into a single assembly which has internal mechanisms which make it possible to perform the operations necessary for both launching and receiving mechanical interfaces. This possibility has not been shown in FIGS. 2 and 3 because it is also widely known to those skilled in the art and does not form part of the scope of the invention.

The idea of distributing the production from an offshore oil well, or the production from a manifold, via U-shaped pipe lengths, as shown makes it possible to operate a true fluids pumping system. In fact the passage of a mechanical interface along the U-shaped pipe length departing from and returning to the gathering centre produces the effect of alternating pumping.

This invention has the great advantage that it allows gas to be injected as the propulsion element for displacing the fluids to the surface from the point of production without increasing the pressure on the well-head which would reduce the production yield from offshore wells and without the flow of produced hydrocarbon mixture suffering any significant reduction. In fact this invention represents an excellent alternative to the offshore well production systems known hitherto, particularly in respect of maintenance and even increasing productivity.

Another major advantage provided by this invention relates to the capacity of mechanical interfaces to remove solid or gelatinous (waxy) products which accumulate on the walls of pipes, which makes its application highly recommended for the pumping of very viscous products, paraffin oils and asphaltenes, and products containing sand, much gas or little gas, and even for wells or manifolds which are located at great depths.

It is obvious that the use of mechanical interfaces which pass through offshore oil production delivery pipes will result in these pipes being always in an optimum condition of cleanliness.

The mechanical interfaces which pass through the pipes during implementation of the method according to this invention may be pigs made of flexible high or low density plastics foam selected in accordance with the characteristics of the pipe system in question. Pigs made of plastics foam preferably but not exclusively of foamed polyurethane have the advantage of low cost and great flexibility, which makes it possible for them to be used in pipes subject to large variations in diameter.

It is clear that pigs made of other simple or composite materials, of multi-component construction or in already known formats, may be used in accordance with design convenience without thereby going beyond the scope of the invention claimed.

As may be seen from the above description, various alternatives may be provided which fall within the scope of the following claims. The description provided in this application has been presented merely as an example for an understanding of the preferred embodiments, without it in any way being possible to regard it as a limitation on the application.

What is claimed is:

1. Equipment for interconnecting an offshore well-head or well manifold to a gathering center and for allowing periodic passage of a mechanical interface so as to promote flow to the gathering center, the equipment comprising:

at least first, second, and third flow lines, said at least first, second and third flow lines being operatively connected together to form first and second U-shaped lengths of pipe, said at least first, second and third flow lines and said U-shaped lengths of pipe formed therefrom being configured to and having an internal size to allow periodic passage of a mechanical interface therethrough;

a surge line adapted to be connected at one end thereof to an offshore well-head or well manifold, said surge line being split into first and second further flow lines, said first further flow line being operatively connected in flow communication with said first U-shaped length of pipe, said second further flow line being operatively connected in flow communication with said second U-shaped length of pipe; and first and second check valves respectively disposed in said first and second further flow lines;

whereby a mechanical interface can be launched into an end of one of said first, second and third flow lines and returned through another of said first, second and third flow lines so as to promote flow, to a gathering center, of material accumulated in said one and said another flow lines.

2. Equipment according to claim 1, wherein only first, second and third flow lines are used to form said first and second U-shaped lengths of pipe, wherein said first flow line is operatively coupled with said third flow line to define said first U-shaped length of pipe and said second flow line is operatively coupled to said third flow line to define the second U-shape length of pipe, and further comprising a plurality of through-flow valves provided in said first and second U-shaped lengths of pipe for selectively allowing travel of a mechanical interface through one or the other of said first and second U-shaped lengths of pipe.

3. Equipment according to claim 1, further comprising a mechanical interface launching device which is fed by a source of high pressure gas, a mechanical interface receiving device, and a surge tank to receive fluids which are caused to flow by the movement of said mechanical interface within said first, second and third flow lines.

4. Equipment according to claim 3, wherein only first, second and third flow lines are used to form said first and second U-shaped lengths of pipe, wherein said first flow line is operatively coupled with said third flow line to define said first U-shaped length of pipe and said second flow line is operatively coupled to said third flow line to define the second U-shape length of pipe, and further comprising a plurality of through-flow valves provided in said first and second U-shaped lengths of pipe for selectively allowing travel of a mechanical interface through one or the other of said first and second U-shaped lengths of pipe.

5. A method for gathering and flowing offshore oil production from a well-head or well-head manifold to a gathering center, using only first, second and third flow lines having first, second, third and fourth clear-flow shut-off valves, said first, second, and third flow lines being operatively connected together to form first and second U-shaped lengths of pipe, said first and second U-shaped lengths of pipe being respectively coupled to a surge line coming from a well head/manifold first and second further flow lines having first and second check valves, said first and second clear-flow shut-off valves being disposed in said first U-shaped length of pipe and said third and fourth clear-flow shut-off valves being disposed in said second U-shaped length of pipe; the method including the following steps:

initially opening said third and fourth clear-flow shut-off valves and closing said first and second clear-flow shut-off valves;

accumulating a volume of hydrocarbon mixture from the well-head/manifold in said second U-shaped pipe length;

when said volume of hydrocarbon mixture has accumulated in said second U-shaped length of pipe, opening said first clear-flow shut-off valve for flowing hydrocarbon mixture from the well-head/manifold into at least a portion of said first U-shaped length of pipe, inserting a mechanical interface into a launching device operatively coupled to said second U-shaped length of pipe and opening a gas feed valve to said launching device;

driving said mechanical interface with a volume of high pressure gas to travel into and along said second U-shaped length of pipe, and to return therethrough to a receiving device, thereby removing hydrocarbon mixture that has accumulated in said second U-shaped pipe length;

during said driving step, using said second check valve to prevent said volume of pressurized gas from reaching said well-head/manifold, and to prevent further fluid mixture from flowing into said second U-shaped pipe length while it is pressurized by said volume of pressurized gas;

when said mechanical interface reaches said receiving device, removing to a surge tank the volume of hydrocarbon mixture that had accumulated in said second U-shaped pipe length, then closing said gas feed valve and opening a first gas discharge valve to depressurize said second U-shaped pipe length, and using gas released by opening said gas discharge valve to initiate the launching, in a next cycle, of said mechanical interface into said first U-shaped pipe length;

opening said second clear-flow shut-off valve and closing said third and fourth clear-flow shut-off valves, thereby allowing hydrocarbon mixture to accumulate in said first U-shaped pipe length;

when said volume of hydrocarbon mixture has accumulated in said first U-shaped pipe length opening said third clear-flow shut-off valve for flowing hydrocarbon mixture from the well-head/manifold into at least a portion of said second U-shaped length of pipe, and inserting a mechanical interface into a launching device operatively coupled to said first U-shaped length of pipe and opening the gas feed valve to said launching device;

driving said mechanical interface with a volume of pressurized gas to pass along said first U-shaped length of pipe, thus removing the volume of hydrocarbon mixture that has accumulated in said first U-shaped length of pipe;

driving said driving step, using said first check valve to prevent said volume of pressurized gas from reaching said well-head/manifold, and to prevent further hydrocarbon mixture from flowing into said first U-shaped pipe length while it is pressurized by said volume of pressurized gas;

when said mechanical interface reaches said receiving device, removing to said surge tank the volume of hydrocarbon mixture that had accumulated in said first U-shaped length of pipe;

closing said gas feed valve and opening a second gas discharge valve to depressurize said first U-shaped pipe length, and using gas released by opening said second gas discharge valve to initiate the launching of a mechanical interface into said second U-shaped pipe length in a next cycle; and opening said fourth clear-flow shut-off valve and closing said first and second clear-flow shut-off valves, thereby allowing filling of said second U-shaped length of pipe.

6. A method for gathering and flowing offshore oil production from a well-head or well-head manifold to a gathering center, using first and second flow lines that form a first U-shaped length of pipe and third and fourth flow lines that form a second U-shaped length of pipe, said first and second U-shaped lengths of pipe being respectively connected to a surge line coming from a well head/manifold with first and second lines having first and second check valves respectively disposed therein; the method including the following steps:

accumulating a volume of hydrocarbon mixture from said well-head/manifold in at least one of said first and second U-shaped lengths of pipe;

when said volume of hydrocarbon mixture has accumulated in said one of said first and second U-shaped pipe lengths, inserting a mechanical interface into a launching device operatively coupled to said first and third flow lines and opening a gas feed valve to said launching device;

driving said mechanical interface with a volume of pressurized gas to pass into and along one of said first and third flow lines and along the respective one of said first and second U-shaped lengths of pipe, and to return to a platform via the other flow line of the respective one of said first and second U-shaped pipe lengths, thus removing the volume of hydrocarbon mixture that has accumulated in said one of said first and second U-shaped lengths of pipe through which said mechanical interface passes;

during said driving step, using one of said first and second check valves to prevent said volume of pressurized gas from passing into said well-head/manifold assembly and, while said mechanical interface is traveling through said one of said first and second U-shaped lengths of pipe, flowing continuing production to flow through the other of said first and second U-shaped lengths of pipe;

when said mechanical interface reaches a receiving device, removing to a surge tank the volume of hydrocarbon mixture which had accumulated in said one of first and second U-shaped lengths of pipe through which said mechanical interface has passed;

closing said gas feed valve;

opening one of first and second gas discharge valves of the respective one of said first and third flow lines so as to allow hydrocarbon mixture to accumulate in the thus depressurized flow lines; and removing said mechanical interface from said receiving device, and in the next cycle using a volume of pressurized gas which is released by opening said one of said first and second gas discharge valves to initiate launching of a mechanical interface into the other said first and third flow lines operatively coupled to said launching device.

* * * * *